US007191804B2

(12) United States Patent
Bamelis et al.

(10) Patent No.: US 7,191,804 B2
(45) **Date of Patent: *Mar. 20, 2007**

(54) THREAD CLAMP FOR A WEAVING MACHINE

(75) Inventors: Jean Marie Bamelis, Ypres (BE); Chris Delanote, Ypres (BE); Jozef Peeters, Ypres (BE); Herman Salomez, Zonnebeke (BE)

(73) Assignee: Picanol N.V., naamloze vennootschap, Ieper (BE)

( * ) Notice: Subject to any disclaimer, the term of this patent is extended or adjusted under 35 U.S.C. 154(b) by 46 days.

This patent is subject to a terminal disclaimer.

(21) Appl. No.: 10/476,878

(22) PCT Filed: May 17, 2002

(86) PCT No.: PCT/BE02/00079

§ 371 (c)(1),
(2), (4) Date: Nov. 13, 2003

(87) PCT Pub. No.: WO02/095105

PCT Pub. Date: Nov. 28, 2002

(65) Prior Publication Data

US 2004/0149344 A1 Aug. 5, 2004

(30) Foreign Application Priority Data

May 21, 2001 (BE) ..... 2001/0347

(51) Int. Cl.
*D03D 47/30* (2006.01)

(52) U.S. Cl. ..... 139/435.1; 139/161.1

(58) Field of Classification Search ..... 139/435.1, 139/161.1, 435.4, 429; 242/419.4, 417.1; 226/122

See application file for complete search history.

(56) References Cited

U.S. PATENT DOCUMENTS

| | | | | |
|---|---|---|---|---|
| 4,512,375 | A * | 4/1985 | Deborde et al. | 139/435.3 |
| 4,722,370 | A * | 2/1988 | Manders | 139/429 |
| 6,014,992 | A * | 1/2000 | Speich | 139/435.1 |
| 6,223,783 | B1 * | 5/2001 | Peeters et al. | 139/435.4 |

FOREIGN PATENT DOCUMENTS

EP 0 316 028 5/1989

OTHER PUBLICATIONS

Lord, Weaving: Conversion of Yarn to Fabric, 1973, Merrow Publishing, p. 371.*

* cited by examiner

*Primary Examiner*—Gary Welch
*Assistant Examiner*—Andrew W. Sutton
(74) *Attorney, Agent, or Firm*—Bacon & Thomas, PLLC

(57) ABSTRACT

A thread clamp for a weaving machine includes a clamp having at least two clamping parts between which a thread may be clamped and an actuator arranged to move the clamping parts between clamping and unclamped positions. The actuator is arranged to operate the clamp so that it moves at least in one direction by a negative fluid pressure. The actuator may be formed as a small piston that may be actuated both by positive pressure and negative pressure to move the clamp between clamping and unclamped positions.

18 Claims, 4 Drawing Sheets

THREAD CLAMP FOR A WEAVING MACHINE

BACKGROUND OF THE INVENTION

A. Field

This invention relates to a thread clamp, in particular for a weaving machine, as well as to a weaving machine using such thread clamp.

B. Related Art

More particularly, the invention relates to a thread clamp which at least consists of an actual clamp with at least two clamping parts between which a thread can be clamped, as well as of actuation means for moving said clamping parts in mutual respect between a closed position, whereby the clamping parts are pushed towards each other, and an open position whereby the clamping parts are situated located at a distance from each other.

It is known that such thread clamps can be used at different locations in a weaving machine. In particular, they are used for gripping weft threads, either for holding them at their place, or for braking and/or stopping them in their movement.

It is also known that such thread clamps can be actuated in different manners.

So, for example, electric actuating means can be used, whereby use is made of an electromagnet or a piezo-actuator for controlling the clamp, for which of course an electric wiring must be provided up to the thread clamp concerned, which often is viewed as disadvantageous, especially if such thread clamp is provided on a moving part, such as the sley of the weaving machine.

It is also known to apply pneumatic actuation means, whereby such thread clamp then is provided with a movable part which can be actuated by means of fluid (air) pressure.

With the known electric as well as the pneumatic embodiments, that is the electric drive and the pneumatic drive, respectively, the clamp is forced into one well-defined position, whereas the clamp, when switching off the actuation means, automatically is brought into the other position, by means of a return spring. The use of such return spring has various disadvantages. A first disadvantage consists in that it is rather difficult to mount a return spring which has a relatively large stroke and which does not vary too much in pre-tension, into a small built-in space, which return spring moreover, notwithstanding the relatively large displacement, does not buckle and also still has a long service life. A second disadvantage consists in that in certain applications, for example, when the thread clamp is mounted on a sley which is moving rapidly to and fro, it may occur that such return spring is excited automatically, for example, due to inertia forces, at moments when this is not desired. A third disadvantage consists in that mutual friction between the windings of the spring may occur, as well as between the spring and the surrounding housing, as a result of which the proper spring functioning can be disturbed. A fourth disadvantage consists in that, with high speeds, undesired effects can be created in such return spring, for example, as windings, so to speak, beat against each other and create undesired effects. A fifth disadvantage consists in that such return springs, due to their manifold movements, are subjected to intense wear and tear.

It is known to apply actuation means which are double-acting, for example, electromagnetic or pneumatic drives with which the thread clamp, by means of a controlled actuation, is forced into opened condition as well as into closed condition, without using passive readjustment means.

This, however, has the disadvantage that a higher number of cables and compressed air conduits, respectively, have to be brought up to the thread clamps concerned, which in particular is a disadvantage with thread clamps which are mounted on a moving part.

The invention provides a thread clamp for a weaving machine which allows new constructional possibilities, control possibilities and combinations of controls, and is very efficient in its use and with which, depending on its form of embodiment, one or more of said disadvantages can be excluded or at least minimized.

To this aim, the invention in the first instance relates to a thread clamp for a weaving machine, which at least consists of an actual clamp with at least two clamping parts between which a thread can be clamped, as well as of actuation means for moving said clamping parts in mutual respect between at least two positions, a closed position, whereby the clamping parts are pushed towards each other, and an open position whereby the clamping parts are situated at a distance from each other, respectively, with as a characteristic that said actuation means comprise at least a pneumatically actuatable part for bringing the clamp into at least one of said two positions, which part also can be actuated by means of a negative pressure, more particularly vacuum.

By using a part which can be actuated by means of negative pressure, the advantage is obtained that new forms of constructions, as well as mounting possibilities are created. Another advantage consists in that a new actuation method is provided for, which, on one hand, enables an efficient control and, on the other hand, allows various new combinations with existing techniques.

Preferably, the thread clamp according to the invention comprises a pneumatically actuatable part which enables the actual clamp, on one hand, to be brought into at least one position by means of at least a negative pressure, and on the other hand, enables the clamp to be forced into the other position by means of at least another manner of actuation. Thereby, a control is offered which has the advantage that two control possibilities are obtained, to wit a control by means of negative pressure, more particularly vacuum, and a control by means of another manner of actuation.

Preferably, the pneumatically actuatable part is configurated such that the clamp is forced into opened condition by means of feeding the negative pressure, whereas the closed condition is brought about by means of the other manner of actuation. The pressure difference which can be created by means of a negative pressure, more particularly a vacuum, even if it should be possible to create an absolute vacuum, in different application thus is too small to provide for a good clamping force, and preferably the negative pressure, thus, as aforementioned, is used for performing the opening of the clamp, whereas for closing the clamp, an actuation then can be provided for in another manner.

For the aforementioned other manner of actuation, preferably use will be made of a medium which is at overpressure, for example, compressed air, such that, depending on the pressure of the available medium, thus larger forces can be generated.

In the most preferred form of embodiment, the actuatable part has a common actuation surface to which the negative pressure can be fed, and the overpressure can be exerted upon, respectively. By using a negative pressure as well as an overpressure, it is thus possible to create, with one of the same actuation surface, forces in two opposed directions and to effect movements of the actuatable part in two opposed directions.

In the aforementioned case, the thread clamp may have a single conduit for pneumatically actuating said actuatable part, which conduit is used in is common for actuating the clamp towards the closed condition as well as for actuating the clamp towards the open condition. An important advantage then consists in that only one operation conduit is necessary, in other words, only one pneumatic conduit, as a consequence of which the pneumatic circuit is considerably simplified, in particular at the location of the thread clamp itself. This advantage is particularly relevant when different thread clamps must be mounted next to each other or if such thread clamps must be mounted next to other parts, as then the small space available often poses a problem and imposes a limitation on the number pneumatic conduits locatable in the direct proximity of the thread clamp.

This is also particularly useful with thread clamps which are mounted on moving parts of a weaving machine, for example, on the sley, as then, thanks to the invention, the number of connecting conduits between the moving parts and the fixed control may remain limited.

In the most preferred form of embodiment, said actuation means are designed such that the movement of the actuatable part is performed exclusively pneumatical, with which it is meant that the movement of this part exclusively takes place under the influence of negative pressure and/or overpressure, realized by means of fluid, possibly, however, assisted by the gravity of certain parts, but surely not assisted by additional means for exerting a displacement force, such as return springs, electromagnetic drive means or the like.

Thanks to the fact that negative pressure is applied, as well as by combining this preferably with a control by means of overpressure, such additional means for exerting a displacement force in fact can completely be excluded, with the advantage that such thread clamp constructively can be realized in a particularly simple manner.

In a practical form of embodiment, said actuatable part consists of at least one small movable piston, the displacement of which controls the opening or closing of the clamp.

Preferably, this small movable piston has a piston surface which opens to a chamber in which an overpressure and negative pressure, respectively, can be created, which permits the small piston to be actuated from one side for performing the displacement thereof in one direction, as well as in the opposite direction, by creating either an overpressure or a negative pressure, more particularly vacuum, in the aforementioned chamber.

In the most preferred form of embodiment, the small piston substantially will consist of a small plunger, one extremity of which forms one of the aforementioned two parts of the actual clamp, whereas the other extremity functions as a piston surface. Hereby, a particularly compact construction of the thread clamp is enabled.

Of course, the invention also relates to weaving machines using at least one thread clamp as described in the aforegoing.

Important applications of such thread clamp on a weaving machine are as follows:

- as a thread clamp at the inlet of the shed of the weaving machine;
- as a thread clamp which cooperates with a main blower or auxiliary main blower;
- as a thread clamp which cooperates with a main blower or auxiliary main blower which is attached on the sley of the weaving machine;
- as a thread clamp at the end of the shed for holding the end of an inserted weft thread;
- as a thread clamp on a moving part of the weaving machine, more particularly on the shed;
- as a thread clamp which cooperates with a thread-preparing system.

BRIEF DESCRIPTION OF THE DRAWINGS

With the intention of better showing the characteristics of the invention, hereafter, as an example without any limitative character, several preferred forms of the invention are described, with reference to the accompanying drawings, wherein.

DETAILED DESCRIPTION OF THE PREFERRED EMBODIMENTS OF THE INVENTION

Figure 1:
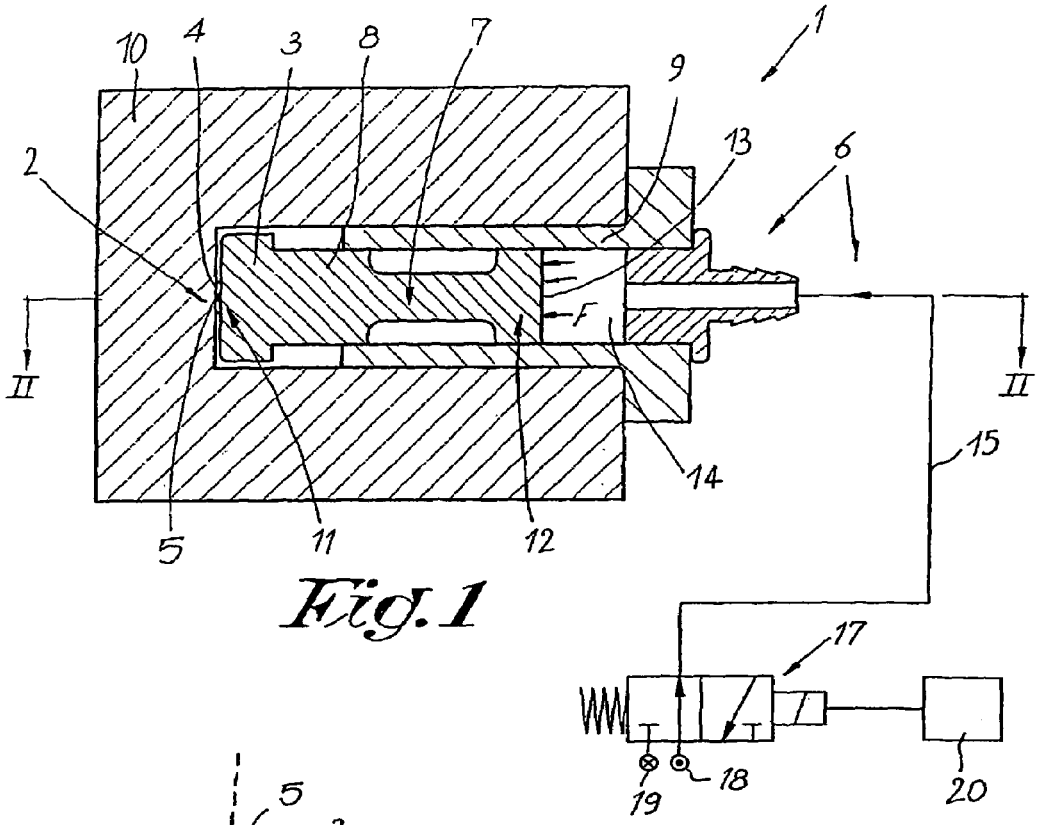
FIG. 1 schematically and in cross-section represents a thread clamp according to the invention in closed condition.
Figure 2:
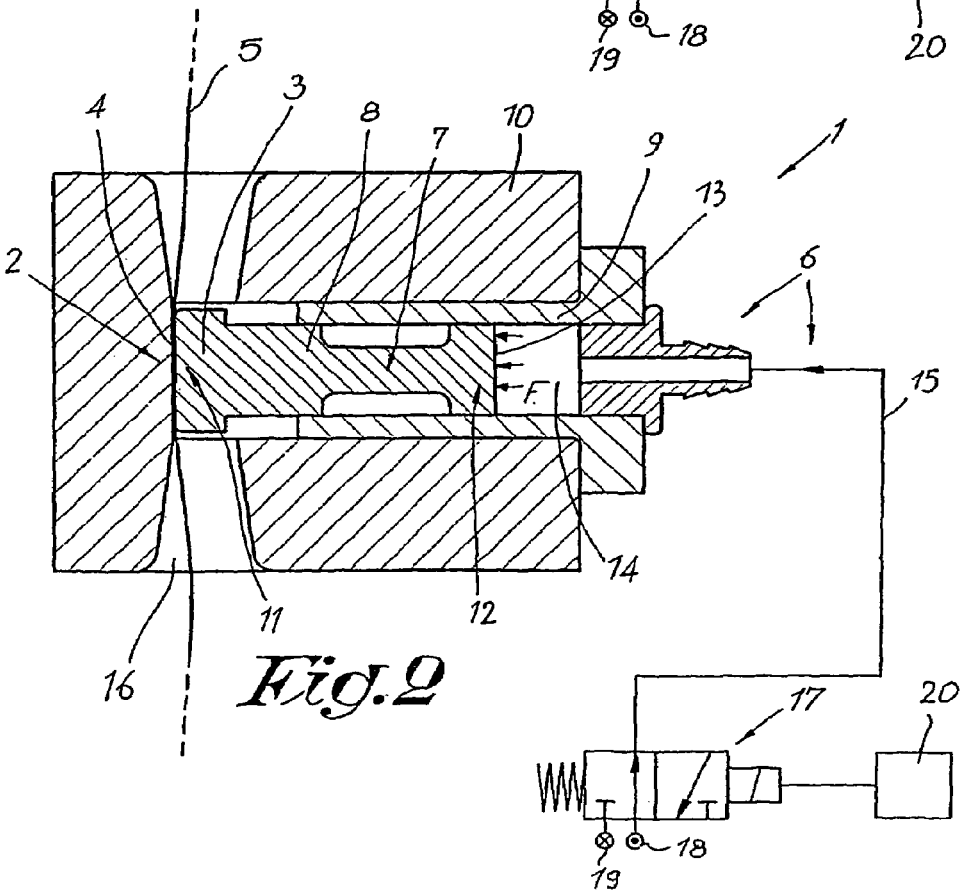
FIG. 2 represents a cross-section taken along line II—II in FIG. 1.
Figure 3:
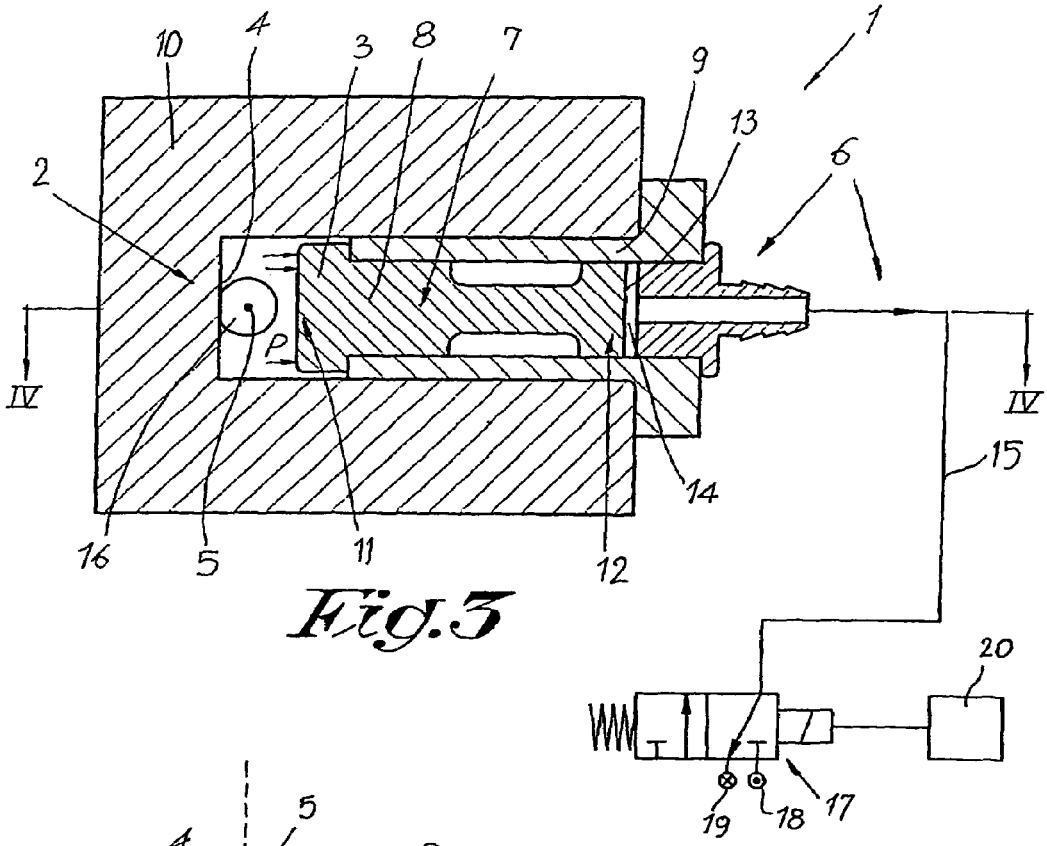
FIGS. 3 and 4 represent views similar to those of FIGS. 1 and 2, however, with the thread clamp opened.
Figure 4:
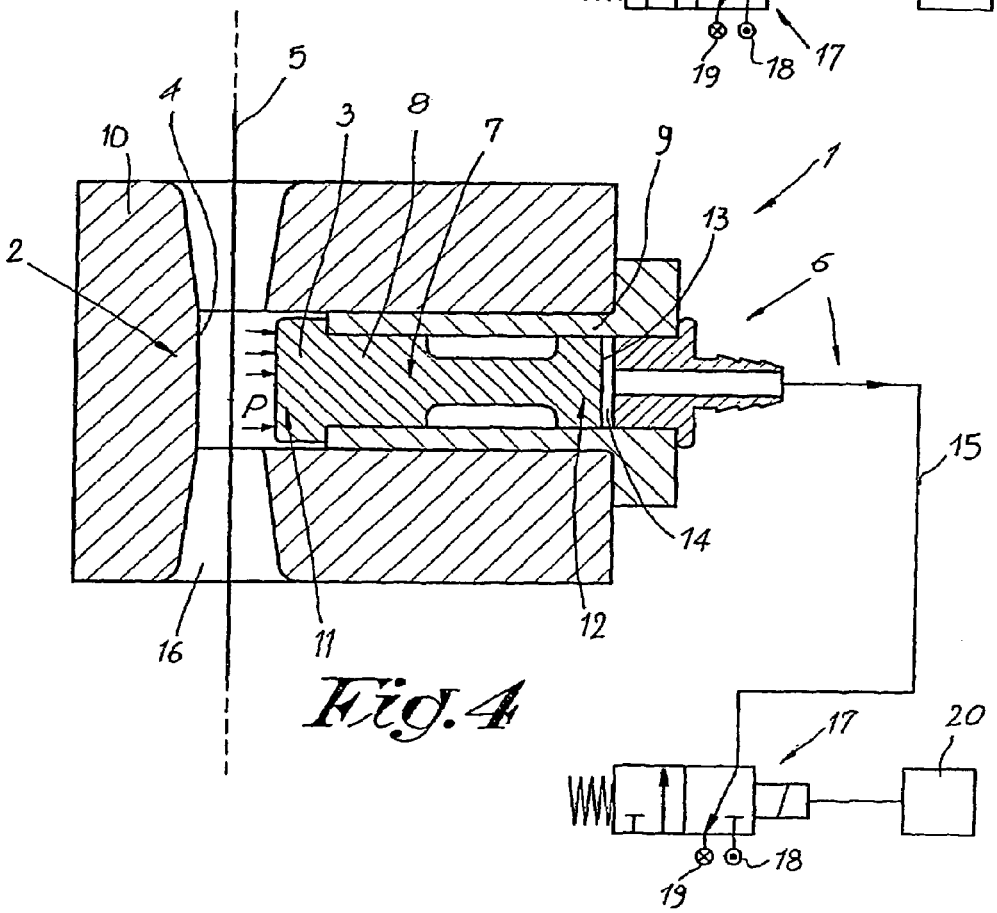

As represented in FIGS. 1 to 4, the invention relates to a thread clamp 1 for a weaving machine, which at least comprises an actual clamp 2 with at least two clamping parts 3–4 between which a thread 5 can be clamped, as well as of actuation means 6 for moving said clamping parts 3–4 in mutual respect between at least two positions, including a closed position, whereby the clamping parts 3–4 are pushed towards each other, as represented in figures 1 and 2, and an open position whereby the clamping parts 3–4 are situated at a distance from each other, as represented in FIGS. 3 and 4.

The particularity of the invention consists in that said actuation means 6 comprise at least a pneumatically actuatable part 7 for bringing the clamp 2 into at least one of the aforementioned two positions, in this case, the open position, by means of a negative pressure, more particularly vacuum.

In the represented example, the actuatable part 7 is formed by a small movable piston 8, the displacement of which controls the opening or closing of the clamp 2. This small piston 8 can be shifted in a cylinder housing 9 which forms part of a housing 10 in which the clamp 2 is installed, too. This small piston 8 preferably consists of a wear and tear-resistant material.

The small piston 8 substantially consists of a small plunger, one extremity 11 of which directly functions as a clamping part 3, whereas at the other extremity 12, an actuating surface in the form of a piston surface 13 is formed, whereby this piston surface 13 terminates in a chamber 14 in which, by means of one common pneumatic operation conduit 15, an overpressure or negative pressure, respectively, can be created.

Said clamping part 4 is situated opposite to the movable clamping part 3 and consists in the represented example of a fixed wall part which forms part of a thread-feeding channel 16 extending substantially perpendicular to the longitudinal direction of the cylinder housing 9, in such a manner that the movable clamping part 3, due to the displacement thereof, can be pressed against the clamping part 4. Hereby, the clamping part 4 forms an abutment.

Said operation conduit 15 is in connection with a valve 17 which, depending on its position, provides for a connection to a supply 18 of a medium under pressure or a vacuum connection 19. The supply 18 may consist of a classical connection to a source of compressed air or a compressed air conduit network. The vacuum connection 19 provides for a connection to, for example, a vacuum pump.

The applied valve 17 may be of different kind. In the example, it consists, as represented schematically, of an electromagnetically actuated 3/2-valve with spring readjustment which is controlled by means of a control unit 20. Of course, a large number of variants thereto is possible.

Hereafter, the functioning of the thread clamp 1 is described by means of the different positions from FIGS. 1 to 4.

When the valve 17 is actuated, it takes up a position as illustrated in FIGS. 1 and 2, as a result of which the supply conduit 15 is put under pressure. Hereby, a force F is exerted upon the piston surface 13, as a result of which the clamp 2 closes and the thread 5 is clamped between the clamping parts 3 and 4.

When the actuation of the valve 17 is removed, a condition is obtained as illustrated in FIGS. 3 and 4, as a result of which the operation conduit 15 and the chamber 14 which is in connection therewith are put under a vacuum, as a result of which the small piston 8, under the influence of the atmospheric pressure P, is moved to the right, as a consequence of which the clamping effect on the thread 5 is undone and the latter can move freely through the thread-feeding channel 16.

The thread clamp 1 according to the invention can be used on all places of a weaving machine where a thread clamp is required.

In consideration of the fact that such clamp can be made particularly In a simple and compact manner with respect to its construction and that it only requires one operation conduit 15, it proves its usefulness in the first place in applications whereby it is installed in a movable manner. An example thereof is described hereafter by means of the FIGS. 5 to 7.

Figure 5:
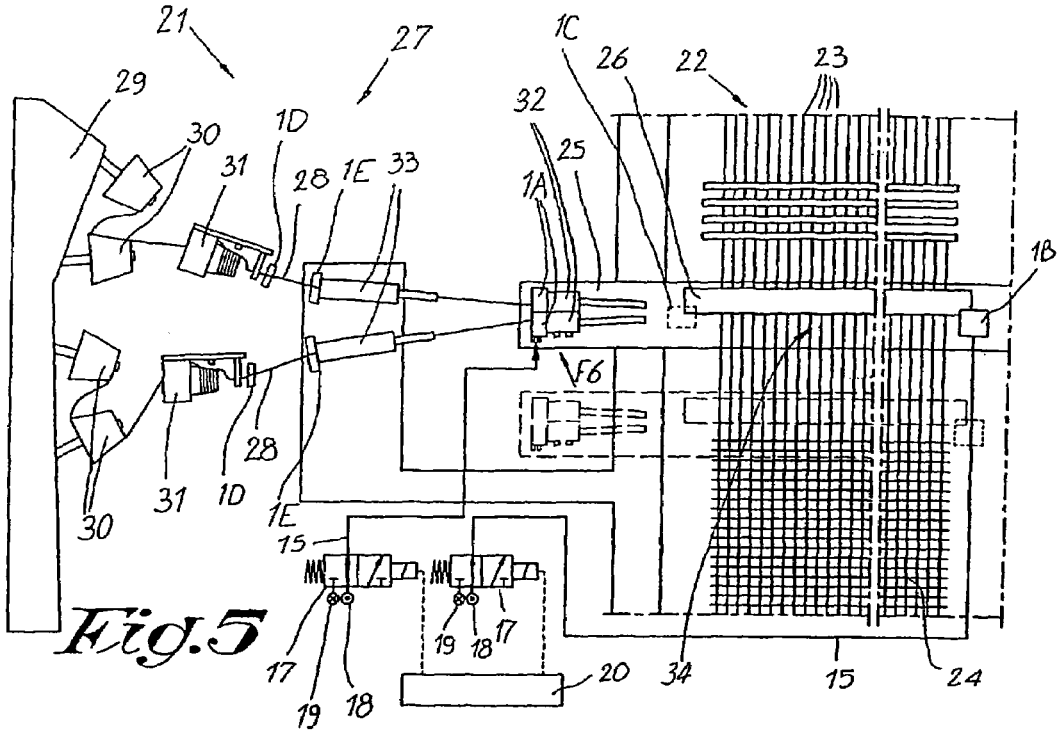
FIG. 5 schematically represents a part of a weaving machine in which thread clamps according to the invention are applied.

FIG. 5 schematically and in plan view shows a part of a weaving machine 21, with as represented parts the warp 22 with the warp threads 23, the formed fabric 24, the to-and-fro-movable sley 25 with the reed 26, and the weft thread feeding means 27 for the weft thread 28. These weft thread feeding means 27 consist of a bobbin rack 29 with bobbins 30, prewinders 31, main blowers 32 mounted, in this case, on the sley 25 and fixedly installed auxiliary main blowers 33.

At the main blowers 32 and at the end of the shed 34, thread clamps 1A, 1B, respectively, are arranged which are made in accordance with the invention. Amongst others, the thread clamps 1A serve for holding the extremities of the weft yarns 28 concerned in the main blowers 32, at the time that these yarns are not inserted. The thread clamp 1B serves for gripping an inserted thread length of a weft yarn 28 at its front extremity upon its arrival at the end of the shed 34. The use of thread clamps on these places is known in itself, however, it is clear that precisely on these places, the application of a thread clamp 1A–1B according to the invention is particularly useful, due to the aforementioned advantages, such as compactness, a minimum of operating conduits 15, and so on.

Figure 7:
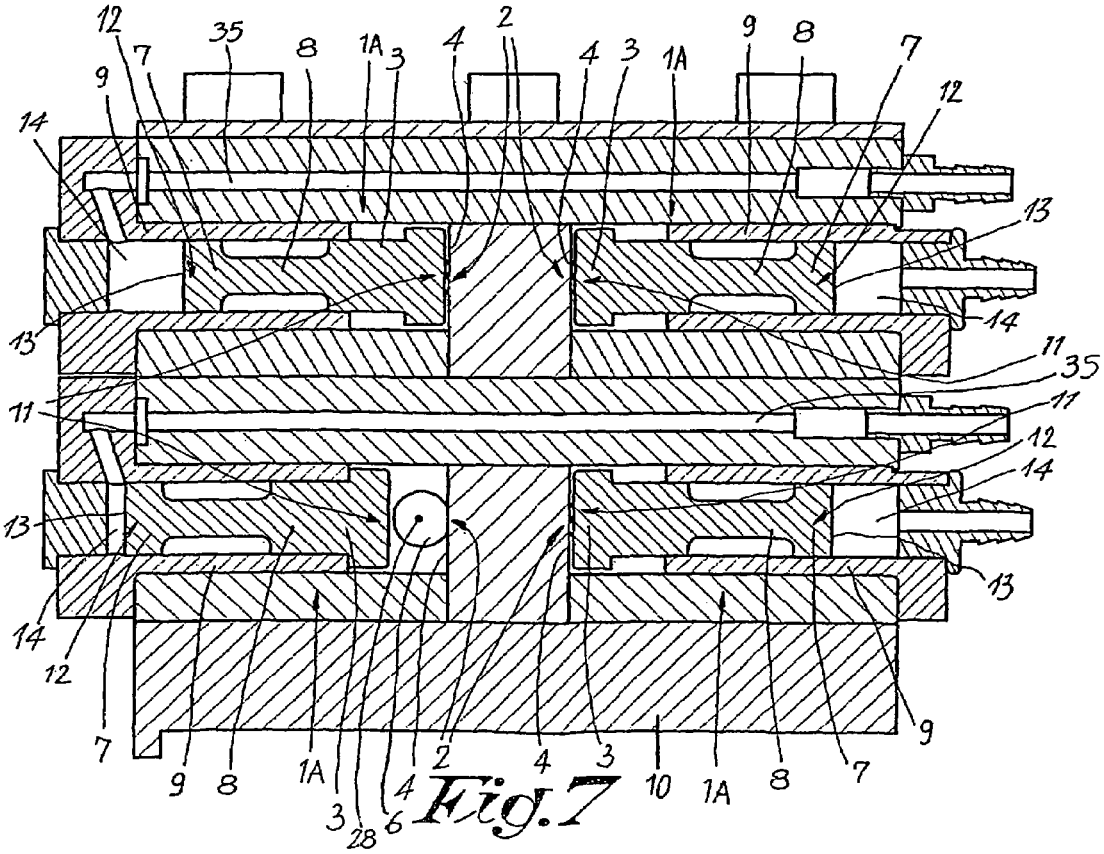
FIG. 7 schematically represents a cross-section, substantially taken along line VII—VII in FIG. 6, whereby this cross-section is performed in a zigzag manner through the thread clamp, such that it each time passes through the respective pneumatic connection conduits.
Figure 6:
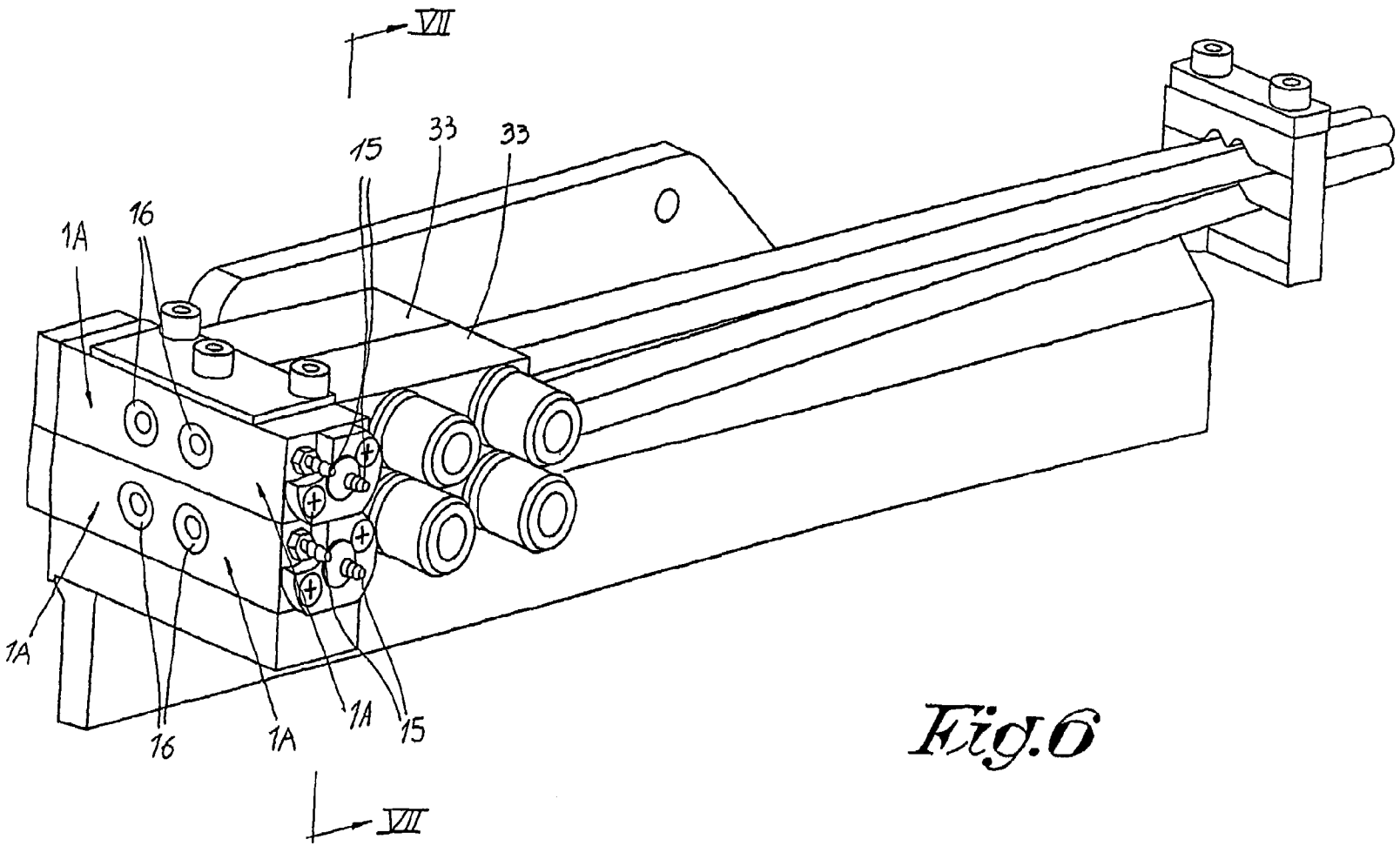
FIG. 6 in perspective represents a view of the part indicated by arrow F6 in FIG. 5.

FIGS. 6 and 7, for example, show that the represented four thread clamps 1A, which belong to the respective four main blowers 32, can be assembled to a very compact unit, whereby only one pneumatic connection per thread clamp 1A is necessary.

It is noted that in FIG. 5, only one valve 17 is indicated, however, that in reality a valve 17 will be present for each thread clamp 1A.

The connections for the operating conduits 15 are all situated at one side, which is advantageous with movably installed thread clamps according to the invention. Hereby, the thread clamps situated at the other side of the housing 10 are in connection with the front side of the housing 10, by means of a bore 35, and subsequently are connected to the respective valve 17 by means of a conduit.

It is clear that different variants are possible. So, for example, does the clamping part 3 not have to form a direct part of the actuatable part 7 and may, according to a variant, be connected thereto by means of a transmission. Also, the actual clamp 2 must not be integrated in the same housing 10 as the actuatable part 7.

In the case of said thread clamp 1B, the thread-feeding channel 16 of this thread clamp 1B is arranged along the direction of the not shown air-guide channel of the reed 26 for guiding the weft thread through the shed 34. Also, such thread clamp 1C may be arranged at the inlet of the shed 34, such thread clamp 1D may be arranged at a thread-preparing system, such as the prewinders 31, or such thread clamp 1E may be arranged at the height of the auxiliary main blowers 33. Such thread clamp also can be integrated in a blower or can be arranged at the outlet thereof. Further, such thread clamp also can be applied at other places in a weaving machine, for example, as a thread clamp in a thread-preparing system, as known from EP 0.316.028 A1.

Also, the actual clamp 2 may be realized in different manners. It must not necessarily have a thread-feeding channel 16. In a more simple form of embodiment, the clamping parts 3 and 4 also may consist of local elements which can cooperate with each other, between which a thread 5 can be guided.

Although the purely pneumatic embodiment with only one pneumatic connection is preferred, the invention is not limited to this embodiment. So, for example, may the use of vacuum be combined with compressed air and/or with passive readjustment means, such as return springs, and/or with other active drive means, for example, of electromagnetic and/or piezo-electric kind.

It is clear that by a negative pressure, a pressure is understood which provides for that the prevailing pressure is lower than the atmospheric pressure. In practice, this will be, for example, an absolute air pressure of 0.2 bar. For closing the clamp 2, one will work with an overpressure, more particularly an absolute air pressure of, for example, 2 to 3 bar.

The present invention is in no way limited to the forms of embodiment described as an example and represented in the FIGS.; on the contrary may such thread clamp be realized according to various variants and be applied on different locations in a weaving machine, without leaving the scope of the invention.

The invention claimed is:

1. Thread clamp for a weaving machine, comprising a clamp having at least two clamping parts between which a thread may be clamped; an actuator arranged to move the clamping parts between at least two positions, including a closed position, wherein the clamping parts are pushed towards each other, and an open position, wherein the clamping parts are disposed at a distance from each other; wherein said actuator comprises at least a small pneumatically actuatable piston which upon actuation moves the clamp into at least one of said two positions, said piston comprising a small plunger having two extremities, one extremity constituting one of said two clamping parts of said clamp, and the other extremity comprising a piston surface disposed in a chamber, and arranged to be actuated by negative pressure supplied to the chamber, and a conduit in communication with said chamber arranged to supply negative pressure to said chamber and piston surface;

wherein said actuator is configured such that its movement is effected exclusively by pneumatic force.

2. Thread clamp according to claim 1, wherein said pneumatically actuatable piston is arranged to be actuated into another position by another actuator arrangement forming part of the thread clamp.

3. Thread clamp according to claim 2, wherein the pneumatically actuatable piston is configured such that the clamp is forced into an open position by means of supplying negative pressure to the chamber and piston surface.

4. Thread clamp according to claim 2, wherein the pneumatically actuatable piston is arranged to be actuated into another position by a pressurized medium, and a conduit arranged to supply a pressurized medium to said chamber and piston surface.

5. Thread clamp according to claim 4, wherein the actuatable piston includes a common actuation surface in said chamber to which the negative pressure is supplied, and against which a pressurized medium is supplied for moving the actuatable piston between said two positions.

6. Thread clamp according to claim 4, wherein said conduits comprise a common operating conduit for supplying both a negative and an overpressure to said chamber for pneumatically actuating said actuatable piston, and thereby actuating the clamp towards the closed position, as well as towards the open position.

7. Thread clamp according to claim 1, wherein the chamber is arranged to be supplied with an overpressure for moving the piston, said conduit also arranged to supply overpressure to said chamber.

8. Thread clamp for a weaving machine, comprising a clamp having at least two clamping parts between which a thread may be clamped; an actuator arranged to move the clamping parts between at least two positions, including a closed position, wherein the clamping parts are pushed towards each other, and an open position, wherein the clamping parts are disposed at a distance from each other; wherein said actuator comprises at least a small pneumatically actuatable piston which upon actuation moves the clamp into at least one of said two positions, said piston comprising a small plunger having two extremities, one extremity constituting one of said two clamping parts of said clamp, and the other extremity comprising a piston surface disposed in a chamber, and arranged to be actuated by negative pressure supplied to the chamber, and a conduit in communication with said chamber arranged to supply negative pressure to said chamber and piston surface;

wherein the chamber is arranged to be supplied with an overpressure for moving the piston, said conduit also arranged to supply overpressure to said chamber.

9. Thread clamp according to claim 8, wherein said pneumatically actuatable piston is arranged to be actuated into another position by another actuator arrangement forming part of the thread clamp.

10. Thread clamp according to claim 9, wherein the pneumatically actuatable piston is configured such that the clamp is forced into an open position by means of supplying negative pressure to the chamber and piston surface.

11. Thread clamp according to claim 9, wherein the pneumatically actuatable piston is arranged to be actuated into another position by a pressurized medium, and a conduit arranged to supply a pressurized medium to said chamber and piston surface.

12. Thread clamp according to claim 11, wherein the actuatable piston includes a common actuation surface in said chamber to which the negative pressure is supplied, and against which a pressurized medium is supplied for moving the actuatable piston between said two positions.

13. Thread clamp according to claim 11, wherein said conduits comprise a common operating conduit for supplying both a negative and an overpressure to said chamber for pneumatically actuating said actuatable piston, and thereby actuating the clamp towards the closed position, as well as towards the open position.

14. Thread clamp for a weaving machine, comprising a clamp having at least two clamping parts between which a thread may be clamped; an actuator arranged to move the clamping parts between at least two positions, including a closed position, wherein the clamping parts are pushed towards each other, and an open position, wherein the clamping parts are disposed at a distance from each other; wherein said actuator comprises at least a small pneumatically actuatable piston which upon actuation moves the clamp into at least one of said two positions, said piston comprising a small plunger having two extremities, one extremity constituting one of said two clamping parts of said clamp, and the other extremity comprising a piston surface disposed in a chamber, and arranged to be actuated by negative pressure supplied to the chamber, and a conduit in communication with said chamber arranged to supply negative pressure to said chamber and piston surface;

wherein said pneumatically actuatable piston is arranged to be actuated into another position by another actuator arrangement forming part of the thread clamp; and wherein the pneumatically actuatable piston is arranged to be actuated into another position by a pressurized medium, and a conduit arranged to supply a pressurized medium to said chamber and piston surface.

15. Thread clamp according to claim 14, wherein the actuatable piston includes a common actuation surface in said chamber to which the negative pressure is supplied, and against which a pressurized medium is supplied for moving the actuatable piston between said two positions.

16. Thread clamp according to claim 14, wherein said conduits comprise a common operating conduit for supplying both a negative and an overpressure to said chamber for pneumatically actuating said actuatable piston, and thereby actuating the clamp towards the closed position, as well as towards the open position.

17. Weaving machine, comprising at least one thread clamp, as claimed in claim 1, 8 or 14.

18. Weaving machine according to claim 17, wherein said thread clamp is a clamp selected from the group consisting of:

a thread clamp at an inlet of a shed of the weaving machine;

a thread clamp which cooperates with a main blower or auxiliary main blower of the weaving machine;

a thread clamp which cooperates with a main blower or auxiliary main blower which is attached on a sley of the weaving machine;

a thread clamp at an end of a shed for holding an end of an inserted weft thread; and a thread clamp which cooperates with a thread-preparing system for the weaving machine.

* * * * *